US012258963B2

(12) United States Patent
Holbrook et al.

(10) Patent No.: US 12,258,963 B2
(45) Date of Patent: Mar. 25, 2025

(54) SCROLL PUMP WITH FLUID RECIRCULATION VALVE

(71) Applicant: Edwards Limited, Burgess Hill (GB)

(72) Inventors: Alan Ernest Kinnaird Holbrook, Burgess Hill (GB); David Bedwell, Burgess Hill (GB); Nigel Paul Schofield, Burgess Hill (GB)

(73) Assignee: Edwards Limited

( * ) Notice: Subject to any disclaimer, the term of this patent is extended or adjusted under 35 U.S.C. 154(b) by 0 days.

(21) Appl. No.: 18/251,484

(22) PCT Filed: Oct. 28, 2021

(86) PCT No.: PCT/GB2021/052799

§ 371 (c)(1),
(2) Date: May 2, 2023

(87) PCT Pub. No.: WO2022/096859

PCT Pub. Date: May 12, 2022

(65) Prior Publication Data

US 2024/0018960 A1 Jan. 18, 2024

(30) Foreign Application Priority Data

Nov. 5, 2020 (GB) ..... 2017511

(51) Int. Cl.
*F04C 18/02* (2006.01)
*F04C 27/00* (2006.01)
(Continued)

(52) U.S. Cl.
CPC ..... *F04C 18/0215* (2013.01); *F04C 18/0292* (2013.01); *F04C 27/005* (2013.01);
(Continued)

(58) Field of Classification Search
CPC ..... F04C 18/0215; F04C 18/0292; F04C 27/005; F04C 28/24; F04C 29/0021; F04C 29/12
See application file for complete search history.

(56) References Cited

U.S. PATENT DOCUMENTS 4,927,339 A * 5/1990 Riffe ..... F04C 27/005 418/55.6
5,129,798 A * 7/1992 Crum ..... F04C 27/005 418/57

(Continued)

FOREIGN PATENT DOCUMENTS

EP 2894339 A1 7/2015
GB 2493552 A 2/2013

(Continued)

OTHER PUBLICATIONS

British Examination Report and Combined Search and Examination Report dated Mar. 19, 2021 and Search Report dated Mar. 18, 2021 for corresponding British application Serial No. GB2017511.3, 5 pages.

(Continued)

*Primary Examiner* — J. Todd Newton
(74) *Attorney, Agent, or Firm* — Theodore M. Magee; Westman, Champlin & Koehler, P.A.

(57) ABSTRACT

A scroll pump includes an inlet and an outlet, a fixed scroll and an orbiting scroll intermeshed with each other, wherein the fixed scroll and orbiting scroll define a space therebetween. The scroll pump further includes a biasing apparatus configured to bias the orbiting scroll against the fixed scroll, a fluid recirculation channel which extends from the space to the inlet through either the fixed scroll or the orbiting scroll, and a fluid recirculation valve disposed in the fluid recirculation channel. The fluid recirculation valve is configured to permit flow of fluid from the space to the inlet through the fluid recirculation channel or to block flow of fluid through (Continued)

the fluid recirculation channel. The fluid recirculation valve is configured to switch from a closed state to an open state when a pressure differential across the fluid recirculation valve is equal to or exceeds a certain threshold value.

12 Claims, 4 Drawing Sheets

(51) Int. Cl.
*F04C 28/24* (2006.01)
*F04C 29/00* (2006.01)
*F04C 29/12* (2006.01)

(52) U.S. Cl.
CPC ..... *F04C 28/24* (2013.01); *F04C 29/0021* (2013.01); *F04C 29/12* (2013.01)

(56) References Cited

U.S. PATENT DOCUMENTS 5,199,280 A * 4/1993 Riffe ..... F04C 29/122 418/188
5,338,159 A * 8/1994 Riffe ..... F04C 18/023 417/205
5,346,376 A * 9/1994 Bookbinder ..... F04C 27/005 418/57
5,383,772 A * 1/1995 Richardson, Jr. ... F04C 18/0215 418/55.6
5,611,674 A 3/1997 Bass et al.
5,639,225 A * 6/1997 Matsuda ..... F04C 18/0215 417/310
5,947,694 A * 9/1999 Hablanian ..... F04C 25/02 418/5
8,932,036 B2 * 1/2015 Monnier ..... F04C 18/0215 418/270
8,998,596 B2 * 4/2015 Nagahara ..... F04C 27/005 418/57
2001/0043878 A1 * 11/2001 Sullivan ..... F04C 28/08 417/410.5
2005/0019176 A1 * 1/2005 Shin ..... F04C 23/008 417/410.5
2006/0198748 A1 * 9/2006 Grassbaugh ..... F04C 27/005 418/55.6
2011/0058972 A1 * 3/2011 Patel ..... F04C 28/26 418/16
2014/0219846 A1 * 8/2014 Ignatiev ..... F04C 18/0215 418/16
2015/0078927 A1 * 3/2015 Forni ..... F04B 25/00 417/244
2015/0152868 A1 * 6/2015 Fu ..... F04C 29/0021 418/55.5

FOREIGN PATENT DOCUMENTS

JP S5535155 A 3/1980
JP H08334094 A 12/1996
JP H09329090 A 12/1997
JP H11280675 A 10/1999
JP 2003161272 A 6/2003
JP 2011052603 A 3/2011
KR 20140112817 A 9/2014

OTHER PUBLICATIONS

PCT Notification of Transmittal of the International Search Report and the Written Opinion of the International Searching Authority, or the Declaration and PCT Search Report dated Feb. 14, 2022 for corresponding PCT application Serial No. PCT/GB2021/052799, 7 pages.
PCT Written Opinion dated Feb. 14, 2022 for corresponding PCT application Serial No. PCT/GB2021/052799, 6 pages.
Response to Demand for International Preliminary Examination dated Sep. 2, 2022 for corresponding PCT application Serial No. PCT/GB2021/052799, 3 pages.
Japanese Notification of Reason for Rejection dated Apr. 15, 2024 for corresponding Japanese application Serial No. 2023-527293, 6 pages.

* cited by examiner

SCROLL PUMP WITH FLUID RECIRCULATION VALVE

CROSS-REFERENCE OF RELATED APPLICATION

This application is a Section 371 National Stage Application of International Application No. PCT/GB2021/052799, filed Oct. 28, 2021, and published as WO 2022/096859A1 on May 12, 2022, the content of which is hereby incorporated by reference in its entirety and which claims priority of British Application No. 2017511.3, filed Nov. 5, 2020.

FIELD

The present invention relates to scroll pumps.

BACKGROUND

Scroll pumps are a known type of pump used in various different industries to pump fluid. Scroll pumps operate by using the relative motion of two intermeshed scrolls (known as a fixed scroll and an orbiting scroll) to pump fluid.

One particular type of scroll pump makes use of loaded axial seals between the two scrolls. The loading is typically provided by springs which bias the two scrolls against each other via the axial seals. It is generally desirable to improve the design of this type of scroll pump.

The discussion above is merely provided for general background information and is not intended to be used as an aid in determining the scope of the claimed subject matter. The claimed subject matter is not limited to implementations that solve any or all disadvantages noted in the background.

SUMMARY

In a first aspect there is provided a scroll pump comprising an inlet and an outlet, a fixed scroll and an orbiting scroll intermeshed with each other, wherein the fixed scroll and orbiting scroll define a space therebetween for pumping fluid through the scroll pump from the inlet to the outlet. The scroll pump further comprises a biasing apparatus configured to bias the orbiting scroll against the fixed scroll, a fluid recirculation channel which extends from the space to the inlet through either the fixed scroll or the orbiting scroll, and a fluid recirculation valve disposed in the fluid recirculation channel. When in an open state, the fluid recirculation valve is configured to permit flow of fluid from the space to the inlet through the fluid recirculation channel. When in a closed state, the fluid recirculation valve is configured to block flow of fluid through the fluid recirculation channel. The fluid recirculation valve is configured to switch from the closed state to the open state when a pressure differential across the fluid recirculation valve is equal to or exceeds a certain threshold value.

The fixed scroll may comprise a first base and a first spiral wall extending from the first base. The orbiting scroll may comprise a second base and a second spiral wall extending from the second base. The scroll pump may further comprise a first seal disposed between the first base and the second spiral wall. The scroll pump may further comprise a second seal disposed between the second base and the first spiral wall. The biasing apparatus may be configured to bias the orbiting scroll against the fixed scroll via the first seal and the second seal.

The first seal and/or the second seal may be formed at least partially from a polymer material. The first seal and/or the second seal may be formed at least partially from Polytetrafluoroethylene.

The first seal and/or second seal may be a channel seal.

The biasing apparatus may comprise one or more springs.

The scroll pump may comprise a drive shaft configured to drive rotation of the orbiting scroll. The biasing apparatus may be configured to exert a force on the orbiting scroll via the draft shaft. The biasing apparatus may be configured to exert a force directly on a bearing coupling the orbiting scroll to the drive shaft.

The fluid recirculation valve may be a check valve.

The scroll pump may further comprise a check valve located at the outlet of the scroll pump.

The certain threshold value may be between 100 mbar and 400 mbar. The certain threshold may be between 200 mbar and 300 mbar. The certain threshold may be 200 mbar.

The scroll pump may comprise an actuator and a drive shaft, the drive shaft being coupled to the orbiting scroll, wherein the actuator is configured to actuate the drive shaft to rotate the drive shaft to drive the orbiting of the orbiting scroll, wherein the fixed scroll is located between the actuator and the orbiting scroll.

The scroll pump may comprise an actuator and a drive shaft, the drive shaft being coupled to the orbiting scroll, wherein the actuator is configured to actuate the drive shaft to rotate the drive shaft to drive the orbiting of the orbiting scroll, wherein the orbiting scroll is located between the actuator and the fixed scroll.

In a second aspect, there is provided the use of the scroll pump of the first aspect to pump fluid.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

DETAILED DESCRIPTION

Figure 1:
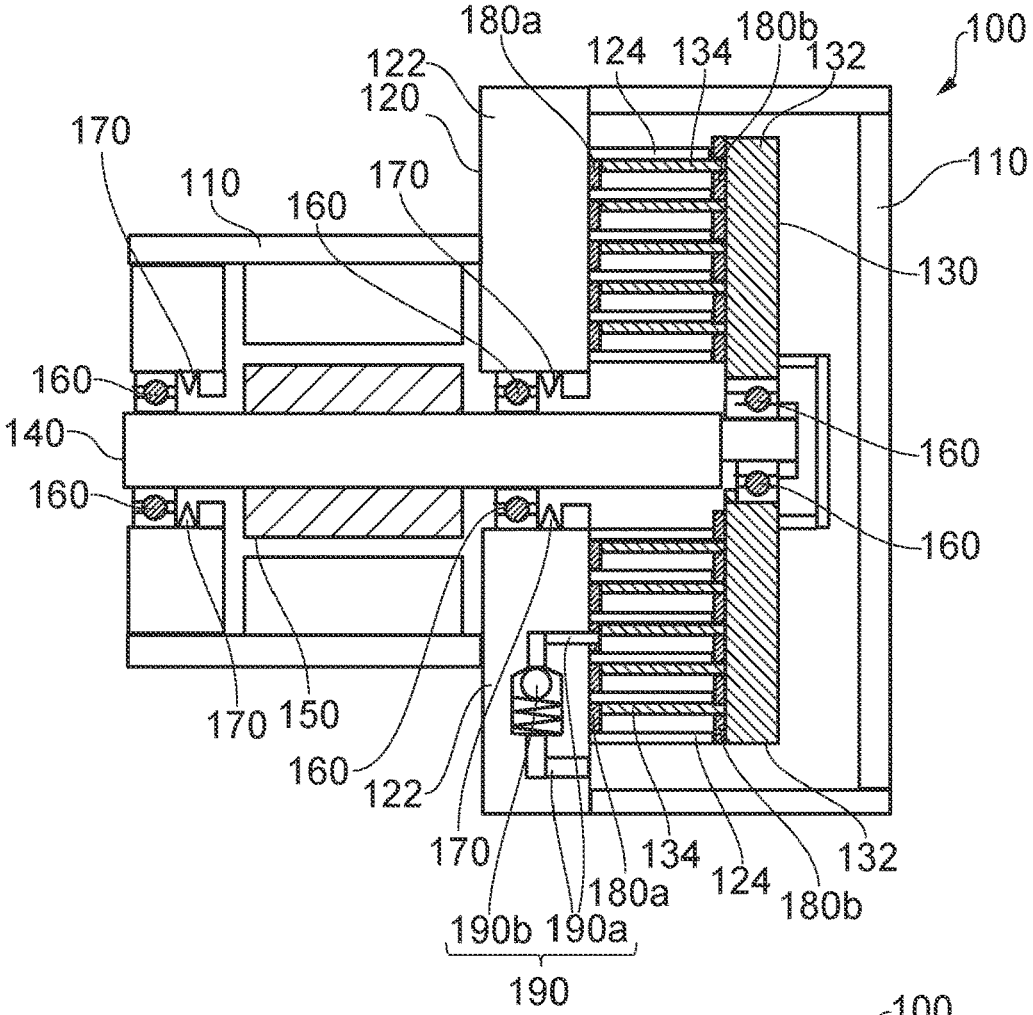
FIG. 1 is a schematic illustration (not to scale) showing a cross-sectional view of a scroll pump.

FIG. 1 is a schematic illustration (not to scale) showing a cross-sectional view of scroll pump 100 according to an embodiment.

The scroll pump 100 comprises a shell 110, a fixed scroll 120, an orbiting scroll 130, a drive shaft 140, an actuator 150, a plurality of bearings 160, a biasing apparatus 170, a first axial seal 180*a*, a second axial seal 180*b*, and a fluid recirculation mechanism 190.

In this embodiment, the shell 110 and the fixed scroll 120 together form an overall housing of the scroll pump 100 within which the rest of the components of the scroll pump 100 are located. However, it will be appreciated that, in other embodiments, the fixed scroll 120 may not form part of the overall housing of the scroll pump 100 and instead may be located entirely within the overall housing.

The orbiting scroll 130 is located within the overall housing of the scroll pump 100 and is intermeshed with the fixed scroll 120. The orbiting scroll 130 is configured to orbit relative to the fixed scroll 120 to pump fluid (e.g. a gas) from an inlet (not shown) of the scroll pump 100 to an outlet (not shown) of the scroll pump 100. The scroll pump 100 may comprise a check valve located at the outlet (which may be referred to as an exhaust check valve). The exhaust check valve is configured to prevent fluid from re-entering the scroll pump 100 when the scroll pump 100 is switched off. This in turn reduces the amount of fluid that can come back out of the inlet of the scroll pump 100, which would cause an undesirable pressure rise in the system being pumped by the scroll pump 100. The exhaust check valve is also configured to prevent exhaust fluid and/or air/oxygen from entering the scroll pump 100, which may react with the pumped fluid.

The physical mechanism by which fluid is pumped by the orbiting of the orbiting scroll 130 relative to the fixed scroll 120 is well known and will not be described herein.

The fixed scroll 120 comprises a first base 122 and a first spiral wall 124. The orbiting scroll 130 comprises a second base 132 and a second spiral wall 134. The first spiral wall 124 extends perpendicularly from the first base 122 towards the second base 132. The second spiral wall 134 extends perpendicularly from the second base 132 towards the first base 122. In this embodiment, the first base 122 and first spiral wall 124 are integrally formed with each other. Also, in this embodiment, the second base 132 and second spiral wall 134 are integrally formed with each other.

The first spiral wall 124 and second spiral wall 134 are intermeshed with each other such that an end surface of the first spiral wall 124 is in contact with an opposing surface of the second axial seal 180*b*, and an end surface of the second spiral wall 134 is in contact with an opposing surface of the first axial seal 180*a*. In this way, the first axial seal 180*a*, first spiral wall 124, second axial seal 180*b* and second spiral wall 134 together define a space between the fixed and orbiting scrolls 120, 130 which is used by the scroll pump 100 during operation to pump fluid. The first and second spiral walls 124, 134 each define a respective spiral shaped channel between the turns or wraps of the spiral wall.

The drive shaft 140 is coupled to the orbiting scroll 130 and configured to rotate to drive the orbiting of the orbiting scroll 130. The drive shaft 140 is located within the overall housing of the scroll pump 100. In this embodiment, the drive shaft 140 is coupled to the orbiting scroll 130 and shell 110 via a plurality of bearings 160 which facilitate rotation of the drive shaft 140. In this embodiment, the draft shaft 140 extends through the fixed scroll 120 and the orbiting scroll 130 is mounted at an end of the draft shaft 140. In this embodiment, the fixed scroll 120 is located between the actuator 150 and the orbiting scroll 130.

The actuator 150 (e.g. a motor) is coupled to the drive shaft 140 and configured to actuate the drive shaft 140 to cause the drive shaft 140 to rotate to drive the orbiting of the orbiting scroll 130. The actuator 150 is located within the overall housing of the scroll pump 100.

The plurality of bearings 160 mechanically couple the drive shaft 140 to the orbiting scroll 130 and the overall housing of the scroll pump 100 such that the drive shaft 140 is able to rotate within the scroll pump 100 to drive the orbiting scroll 130. In this embodiment, the plurality of bearings 160 comprise a bearing 160 located between (and mechanically coupling) a first end of the drive shaft 140 and the overall housing of the scroll pump 100, a bearing 160 located between (and mechanically coupling) the fixed scroll 120 and the drive shaft 140, and a bearing 160 located between (and mechanically coupling) the orbiting scroll 130 and a second end of the drive shaft 140 opposite to the first end.

The biasing apparatus 170 is configured to bias the fixed and orbiting scrolls 120, 130 against each other. More specifically, the biasing apparatus 170 is configured to bias the orbiting scroll 130 towards the fixed scroll 120 such that the orbiting scroll 130 is axially loaded against the fixed scroll 120 via the first axial seal 180*a* and the second axial seal 180*b*. In more detail, the biasing is such that the end surface of the first spiral wall 124 is pressed against the opposing surface of the second axial seal 180*b*, and the end surface of the second spiral wall 134 is pressed against the opposing surface of the first axial seal 180*a*. Thus, the axial load on the fixed and orbiting scrolls 120, 130 is at least partially supported by the first and second axial seals 180*a*, 180*b*. The axial loading caused by the biasing apparatus 170 maintains a seal between the end surfaces of the first and second spiral walls 124, 134 and the respective opposing surfaces of the first and second axial seals 180*a*, 180*b*. This tends to act to prevent undesired leakage of fluid between different radial portions of the space between the fixed and orbiting scrolls 120, 130. In this embodiment, the biasing apparatus 170 comprises a plurality of springs which are configured to exert a force on the orbiting scroll 130 via a plurality of the bearings 160 and the drive shaft 140 in order to bias the orbiting scroll 130 towards the fixed scroll 120. Specifically, in this embodiment, the plurality of springs comprise a spring configured to exert a force on the bearing 160 located between the first end of the drive shaft 140 and the overall housing of the scroll pump 100, and a spring configured to exert a force on the bearing 160 located between the fixed scroll 120 and the drive shaft 140. However, in other embodiments, the biasing apparatus 170 comprises only one spring (e.g. either one of the springs described above).

The first and second axial seals 180*a*, 180*b* are seals located in the channels defined by the spiral walls 124, 134 of the fixed and orbiting scrolls 120, 130. These seals may also be referred to as channel seals. Each of the first and second axial seals 180*a*, 180*b* is a spiral shaped piece of material which is sized to fit snugly in the channels defined by the spiral walls 124, 134. The first axial seal 180*a* is adjacent to the first base 122 and fully extends across the width of the channel defined by the first spiral wall 124. The first axial seal 180*a* is located between the second spiral wall 134 and the first base 122. The second axial seal 180*b* is adjacent to the second base 132 and fully extends across the width of channel defined by the second spiral wall 134. The second axial seal 180*b* is located between the first spiral wall 124 and the second base 132. In this embodiment, the first and second axial seals 180*a*, 180*b* are both formed from Polytetrafluoroethylene (PTFE). However, in general, it will be appreciated that one or both of the first and second axial seals 180*a*, 180*b* may be formed from one or more other types of material (e.g. other types of polymer which may be filled with carbon or glass to reduce wear).

The fluid recirculation mechanism 190 comprises a fluid recirculation channel 190*a* and a fluid recirculation valve 190*b* located in the fluid recirculation channel 190*a*. In this embodiment, the fluid recirculation channel 190*a* extends through the fixed scroll 120 from the space defined between the fixed and orbiting scrolls 120, 130 to the inlet of the scroll pump 100. More specifically, in this embodiment, the fluid recirculation channel 190*a* extends through the first axial seal 180*a* and first base 122 of the fixed scroll 120. The fluid recirculation valve 190*b* is disposed in the fluid recirculation channel 190*a* and is configured to permit flow of fluid through the fluid recirculation channel 190*a* when open and to block flow of fluid through the fluid recirculation channel 190*a* when closed. The fluid recirculation valve 190*b* is configured to be in the closed state when the fluid pressure differential across the fluid recirculation valve 190*b* is below a certain threshold value. However, when the fluid pressure differential across the fluid recirculation valve 190*b* is equal to or exceeds the certain threshold value, the fluid recirculation valve 190*b* is configured to switch from the closed state into the open state in order to allow fluid flow out of the space between the scrolls, thereby reducing the pressure in the space defined between the fixed and orbiting scrolls 120, 130. The threshold value is a value in the range 100 mbar-400 mbar. In scroll pumps such as the ones illustrated in the Figures, tests have revealed that 100 mbar tends to be the lowest pressure differential that will deliver a significant and effective reduction in the scroll lift-off force. Also, tests have revealed that 400 mbar tends to be the highest pressure differential that will be generated by scroll pumps of the type illustrated in the Figures. Preferably, the threshold value is a value in the range 200 mbar-300 mbar. More preferably, the threshold value is 200 mbar.

The entrance to the fluid recirculation channel 190*a* is fluidly connected to the space between the scrolls, the exit of the fluid recirculation channel 190*a* is fluidly connected to the inlet of the scroll pump 100, and the fluid recirculation valve 190*b* is disposed in the fluid recirculation channel 190*a* between the entrance and exit of the fluid recirculation channel 190*a*. When the fluid recirculation valve 190*b* is in a closed state, the fluid pressure differential across the fluid recirculation valve 190*b* is equal to the pressure differential between the pressure at the entrance to the fluid recirculation channel 190*a* from the space between the scrolls and the pressure at the inlet of the scroll pump 100 (i.e. the pressure differential is equal to the pressure at the entrance to the fluid recirculation channel 190*a* minus the pressure at the inlet of the scroll pump 100). Thus, the fluid recirculation valve 190*b* essentially acts as a blow-off valve which activates to relieve high internal pressure in the scroll pump 100 when required. In this embodiment, the fluid recirculation valve 190*b* is a spring loaded check valve which makes use of an elastomeric ball to seal against an opening. However, it will be appreciated that in general any appropriate type of valve may be used, e.g. a check valve which makes use of a differently shaped pad to seal against the opening.

Figure 2:
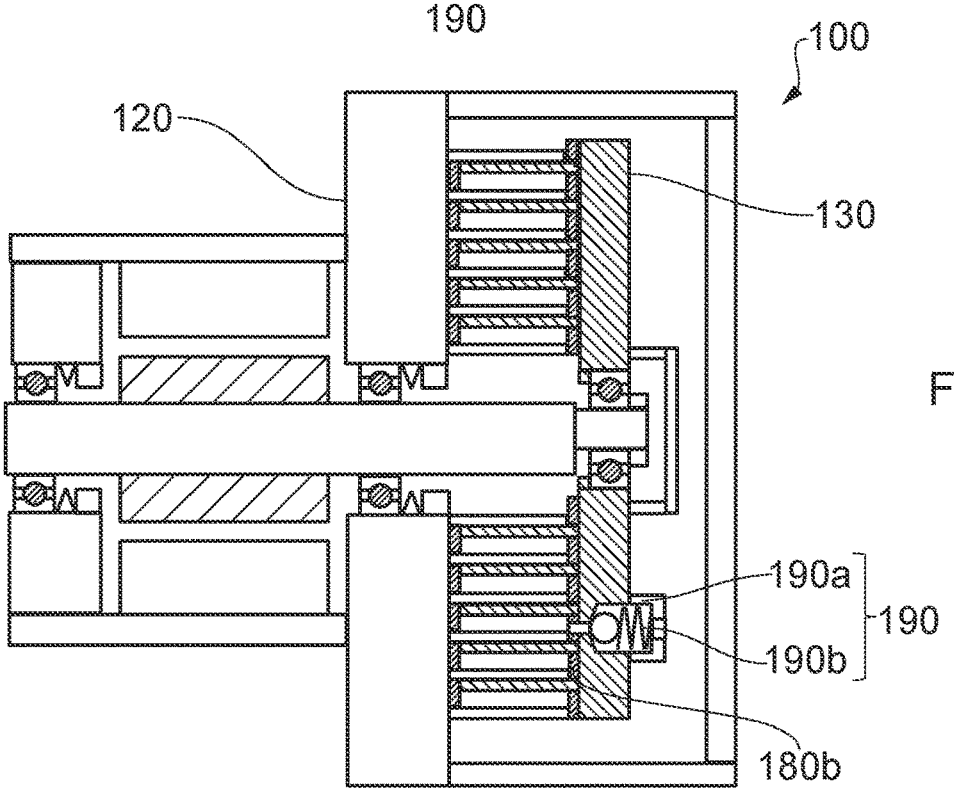
FIG. 2 is a schematic illustration (not to scale) showing a cross-sectional view of another scroll pump.

FIG. 2 is a schematic illustration (not to scale) showing a cross-sectional view of a scroll pump 100 according to another embodiment. The scroll pump 100 of FIG. 2 is the same as the one described above with reference to FIG. 1 except that the fluid recirculation mechanism 190 is in the orbiting scroll 130 instead of the fixed scroll 120. More specifically, in this embodiment, the fluid recirculation channel 190*a* extends through the orbiting scroll 130 from the space defined between the fixed and orbiting scrolls 120, 130 to the inlet of the scroll pump 100. In particular, the fluid recirculation channel 190*a* extends through the second axial seal 180*b* and the second base 132 of the orbiting scroll 130.

Figure 3:
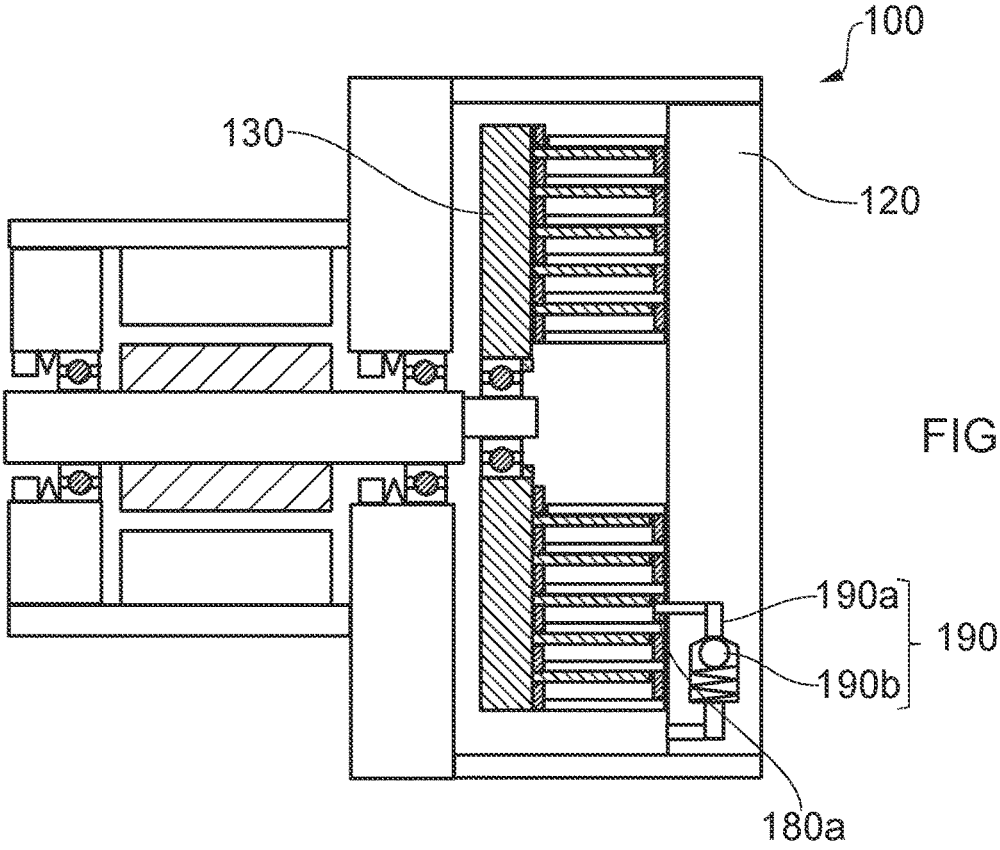
FIG. 3 is a schematic illustration (not to scale) showing a cross-sectional view of yet another scroll pump.

FIG. 3 is a schematic illustration (not to scale) showing a cross-sectional view of a scroll pump 100 according to yet another embodiment. The scroll pump 100 of FIG. 3 is the same as the scroll pump 100 described above with reference to FIG. 1, except that the fixed scroll 120 is located on the other side of the orbiting scroll 130. In other words, rather than the fixed scroll being located between the actuator 150 and the orbiting scroll 130, in the embodiment of FIG. 3, the orbiting scroll 130 is located between the actuator 150 and the fixed scroll 120. In this embodiment, the drive draft 140 does not pass through the fixed scroll 120.

Figure 4:
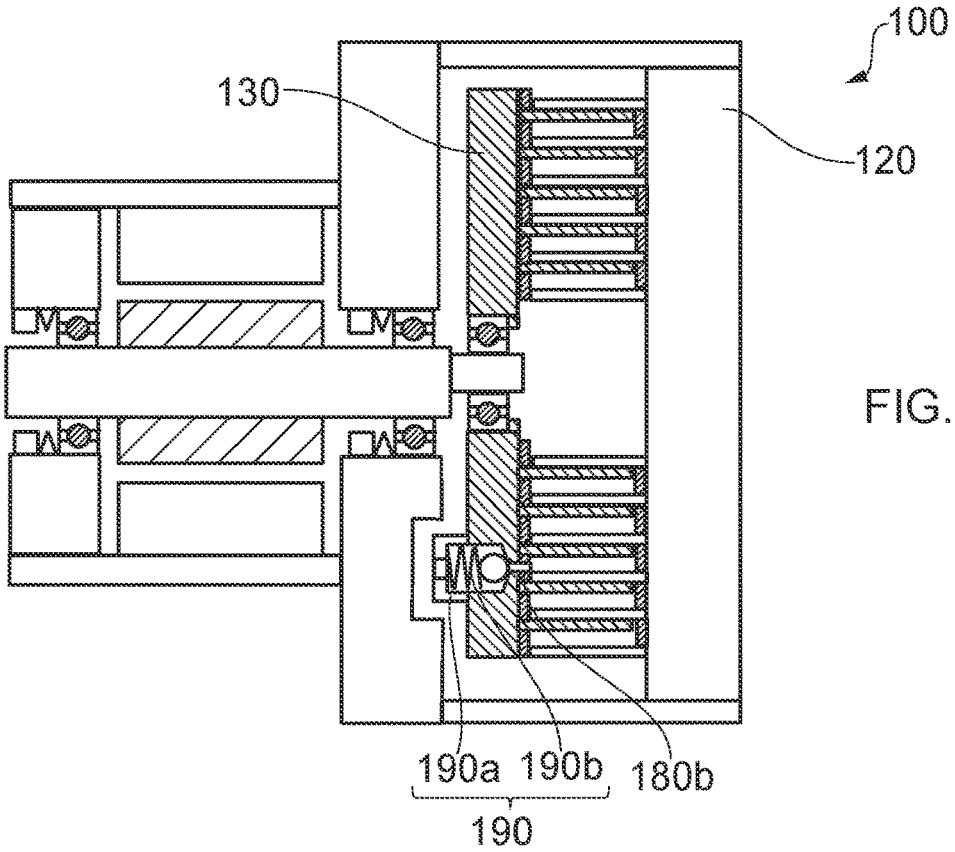
FIG. 4 is a schematic illustration (not to scale) showing a cross-sectional view of yet another scroll pump.

FIG. 4 is a schematic illustration (not to scale) showing a cross-sectional view of a scroll pump 100 according to yet another embodiment. The scroll pump 100 of FIG. 4 is the same as the scroll pump 100 described above with reference to FIG. 3, except that the fluid recirculation mechanism 190 is in the orbiting scroll 130 instead of the fixed scroll 120. More specifically, in this embodiment, the fluid recirculation channel 190*a* extends through the orbiting scroll 130 from the space defined between the fixed and orbiting scrolls 120, 130 to the inlet of the scroll pump 100. In particular, the fluid recirculation channel 190*a* extends through the second axial seal 180*b* and the second base 132 of the orbiting scroll 130.

Figure 5:
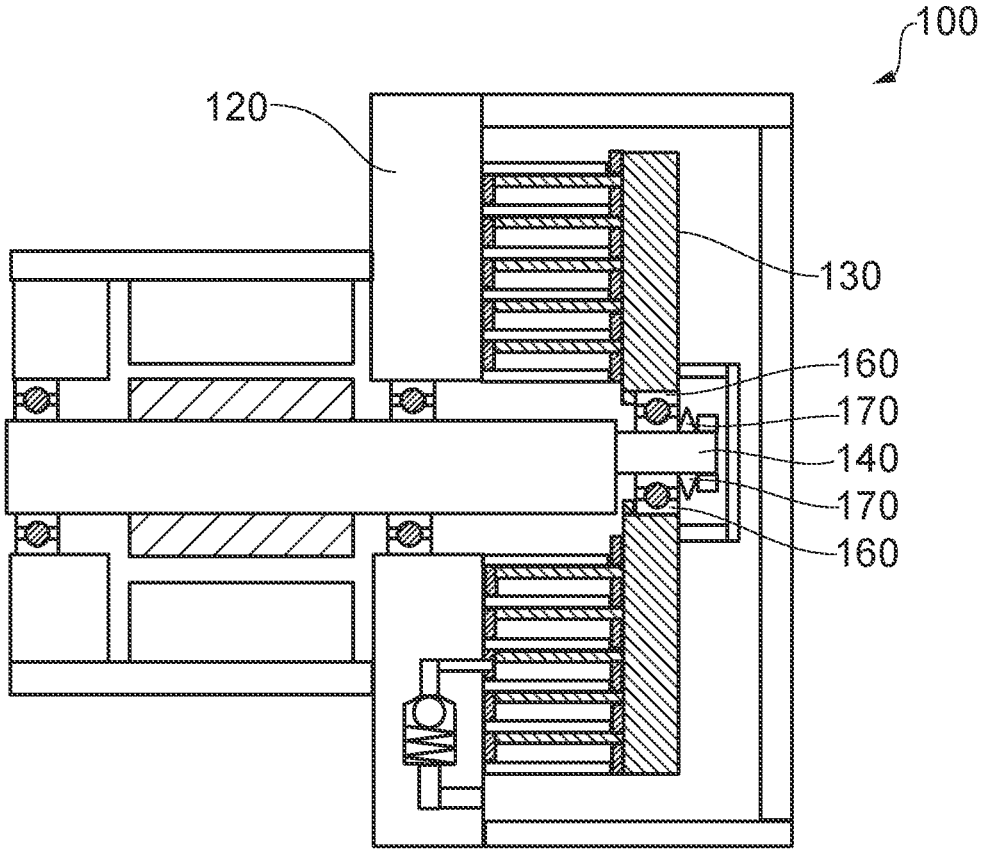
FIG. 5 is a schematic illustration (not to scale) showing a cross-sectional view of yet another scroll pump.

FIG. 5 is a schematic illustration (not to scale) showing a cross-sectional view of a scroll pump 100 according to yet another embodiment. The scroll pump 100 of FIG. 5 is the same as the scroll pump 100 described above with reference to FIG. 1, except that the biasing apparatus 170 comprises only one spring which is attached at one end to the drive shaft 140 and at the other end to the bearing 160 which mechanically couples the orbiting scroll 130 to the drive shaft 140. In this embodiment, the biasing apparatus 170 (specifically the spring) is configured to apply a biasing force directly on the bearing 160 which mechanically couples the orbiting scroll 130 to the drive shaft 140. The biasing force acts to push the orbiting scroll 130 towards the fixed scroll 120 to bias the fixed and orbiting scrolls 120, 130 together.

Figure 6:
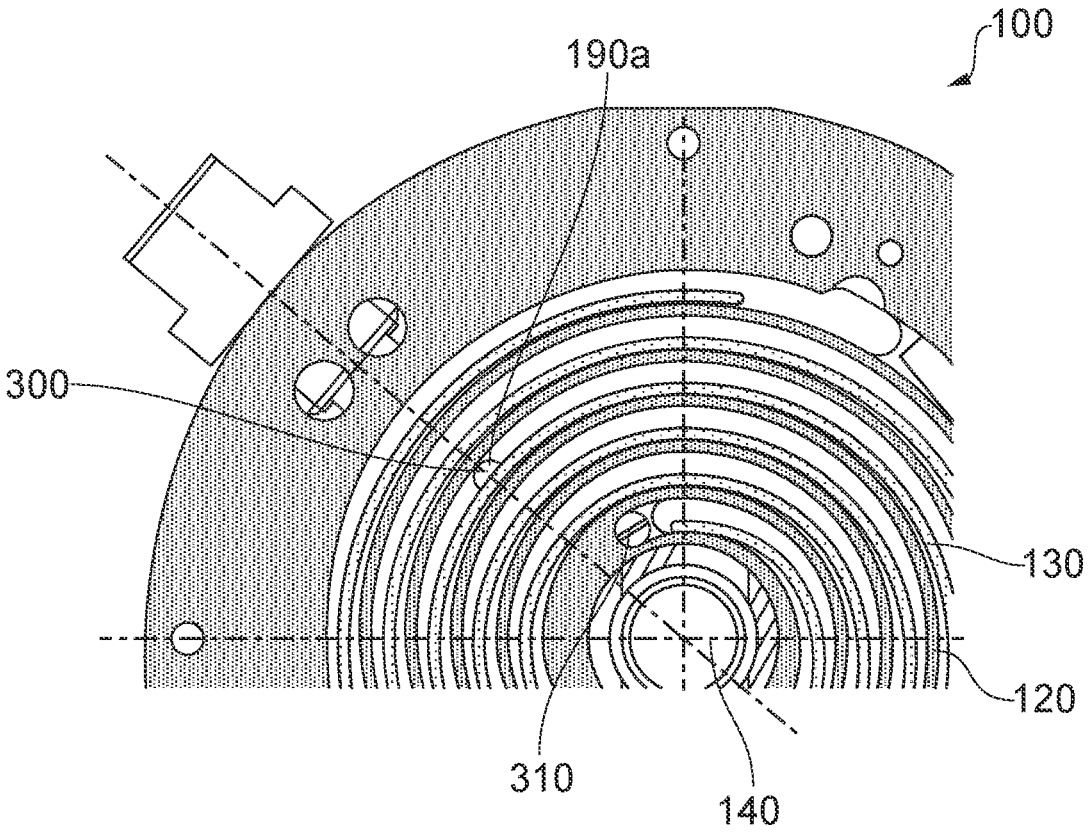
FIG. 6 is a schematic illustration (not to scale) showing a further view of the scroll pump of FIG. 1.

FIG. 6 is a schematic illustration (not to scale) showing a further view of the scroll pump of FIG. 1. As illustrated, an entrance 300 of the fluid recirculation channel 190*a* is located in the fixed scroll 120 and extends, through the fixed scroll 120, from the space defined between the fixed and orbiting scrolls 120, 130 to the inlet 310 of the scroll pump 100. As illustrated, in this embodiment, the entrance 300 to the fluid recirculation channel 190*a* is located at position radially outwards of a centre line of the scroll pump 100 defined by the drive shaft 140. More specifically, the entrance 300 is located at a position such that there are three turns (or wraps) of the spiral walls between the entrance and the centre line in the radial direction. However, in general, it will be appreciated that the entrance 300 may be located at any other appropriate location on the scroll, as long as it is able to provide the above-described functions.

In scroll pumps of the type described above, there tends to be high internal pressures in the space between the fixed and orbiting scrolls at various points in the scroll pump's operation (e.g. due to the scroll pump being exposed to varying inlet pressure, varying ambient exhaust pressure, and use of an exhaust check valve). These pressures act on the orbiting scroll, pushing back against the biasing apparatus. If the forces created by these high internal pressures overcome the biasing force provided by the biasing apparatus, the orbiting scroll can be forced away from the fixed scroll so that the spiral walls of the fixed and orbiting scrolls no longer contact the opposing surfaces of the axial seals (an effect called "lift-off"). This causes radial leakage and loss of pump performance. Thus, the biasing force provided by the biasing apparatus tends to be high to prevent the orbiting scroll lifting off. This high axial loading tends to lead to the use of large orbiting scroll bearings and a high wear rate for the axial seals. However, in the above-described scroll pumps 100, the use of the fluid recirculation mechanism 190 to relieve the pressure in the space between the fixed and orbiting scrolls 120, 130, tends to advantageously avoid these above-described problems. In particular, the fluid recirculation mechanism 190 tends to enable the use of a biasing apparatus 170 which provides less biasing force on the orbiting scroll 130, which in turn tends to enable smaller orbiting scroll bearings to be used and also tend to reduce wear on the axial seals 180*a*, 180*b*.

Furthermore, the presence of the fluid recirculation mechanism 190 tends to facilitate the use of an exhaust check valve. This is because the presence of an exhaust check valve tends to increase the pressures in the space between the scrolls, which tends to lead to lift-off being more likely—the presence of the fluid recirculation mechanism 190 counteracts this risk.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A scroll pump, comprising:

an inlet and an outlet;

a fixed scroll and an orbiting scroll intermeshed with each other, wherein the fixed scroll and orbiting scroll define a space therebetween for pumping fluid through the scroll pump from the inlet to the outlet, a biasing apparatus configured to bias the orbiting scroll against the fixed scroll;

a fluid recirculation channel separate to the biasing apparatus, wherein the fluid recirculation channel extends from the space to the inlet through either the fixed scroll or the orbiting scroll; and a fluid recirculation valve disposed in the fluid recirculation channel, wherein:

when in an open state, the fluid recirculation valve is configured to permit flow of fluid from the space to the inlet through the fluid recirculation channel, when in a closed state, the fluid recirculation valve is configured to block flow of fluid through the fluid recirculation channel, and the fluid recirculation valve is configured to switch from the closed state to the open state whenever a pressure differential across the fluid recirculation valve is equal to or exceeds a certain threshold value;

wherein the scroll pump comprises a drive shaft configured to drive rotation of the orbiting scroll, wherein the biasing apparatus is configured to exert a force directly on a bearing coupling the orbiting scroll to the drive shaft.

2. The scroll pump of claim 1, wherein:

the fixed scroll comprises a first base and a first spiral wall extending from the first base, the orbiting scroll comprises a second base and a second spiral wall extending from the second base, the scroll pump further comprises a first seal disposed between the first base and the second spiral wall, the scroll pump further comprises a second seal disposed between the second base and the first spiral wall, and wherein the biasing apparatus is configured to bias the orbiting scroll against the fixed scroll via the first seal and the second seal.

3. The scroll pump of claim 2 wherein the first seal and/or the second seal is formed at least partially from a polymer material, wherein the polymer material is preferably Polytetrafluoroethylene.

4. The scroll pump of claim 2, wherein the first seal and/or second seal is a channel seal.

5. The scroll pump of claim 1, wherein the biasing apparatus comprises one or more springs.

6. The scroll pump of claim 1, further comprising a check valve located at the outlet of the scroll pump.

7. The scroll pump of claim 1, wherein the certain threshold value is between 100 mbar and 400 mbar.

8. The scroll pump of claim 7, wherein the certain threshold is between 200 mbar and 300 mbar.

9. The scroll pump of claim 8, wherein the certain threshold is 200 mbar.

10. The scroll pump of claim 1, wherein the scroll pump further comprises an actuator, wherein the actuator is configured to actuate the drive shaft to rotate the drive shaft to drive the orbiting of the orbiting scroll, wherein the fixed scroll is located between the actuator and the orbiting scroll.

11. A method comprising using the scroll pump of claim 1 to pump fluid.

12. A scroll pump, comprising:

an inlet and an outlet;

a fixed scroll and an orbiting scroll intermeshed with each other, wherein the fixed scroll and orbiting scroll define a space therebetween for pumping fluid through the scroll pump from the inlet to the outlet, a biasing apparatus configured to bias the orbiting scroll against the fixed scroll;

a fluid recirculation channel separate to the biasing apparatus, wherein the fluid recirculation channel extends from the space to the inlet through either the fixed scroll or the orbiting scroll; and a fluid recirculation valve disposed in the fluid recirculation channel, wherein:

when in an open state, the fluid recirculation valve is configured to permit flow of fluid from the space to the inlet through the fluid recirculation channel, when in a closed state, the fluid recirculation valve is configured to block flow of fluid through the fluid recirculation channel, and the fluid recirculation valve is configured to switch from the closed state to the open state whenever a pressure differential across the fluid recirculation valve is equal to or exceeds a certain threshold value;

wherein the scroll pump comprises a drive shaft configured to drive rotation of the orbiting scroll, wherein the biasing apparatus is configured to exert a force on a bearing coupling the orbiting scroll to the drive shaft.

* * * * *